US006955282B1

(12) United States Patent
Kimple

(10) Patent No.: US 6,955,282 B1
(45) Date of Patent: Oct. 18, 2005

(54) MAGNETICALLY OPERATED DRIVING TOOL

(76) Inventor: David W. Kimple, 1159 N. Donald La., Conway Springs, KS (US) 67031

( * ) Notice: Subject to any disclaimer, the term of this patent is extended or adjusted under 35 U.S.C. 154(b) by 0 days.

(21) Appl. No.: 10/833,230

(22) Filed: Jul. 30, 2004

(51) Int. Cl.[7] ..... B25C 1/04
(52) U.S. Cl. ..... 227/131; 227/129; 227/113; 173/202
(58) Field of Search ..... 227/113, 131, 129, 227/156; 173/114, 117, 202; 310/80, 103

(56) References Cited

U.S. PATENT DOCUMENTS

| | | | | |
|---|---|---|---|---|
| 2,943,216 | A * | 6/1960 | Spodig | 310/103 |
| 2,967,302 | A * | 1/1961 | Loveless | 173/117 |
| 3,609,425 | A * | 9/1971 | Sheridan | 310/103 |
| 3,899,703 | A | 8/1975 | Kinnison | |
| 4,011,477 | A * | 3/1977 | Scholin | 310/80 |
| 4,183,453 | A | 1/1980 | Barrett et al. | |
| 4,370,906 | A * | 2/1983 | Gurries | 81/464 |
| 4,371,798 | A * | 2/1983 | Kuroda | 310/80 |
| 4,491,262 | A * | 1/1985 | Ewig | 227/131 |
| 4,511,074 | A * | 4/1985 | Kille et al. | 227/113 |
| 4,611,742 | A | 9/1986 | Rieker et al. | |
| 5,584,367 | A * | 12/1996 | Berdut | 188/267 |
| 6,232,689 | B1 | 5/2001 | Fujita et al. | |
| 6,364,193 | B1 | 2/2002 | Tsai | |
| 6,433,452 | B1 | 8/2002 | Graham | |
| 6,517,560 | B1 * | 2/2003 | Toth et al. | 606/171 |
| 6,796,477 | B2 * | 9/2004 | Chen | 227/2 |

* cited by examiner

*Primary Examiner*—Scott A. Smith

(57) ABSTRACT

A magnetically operated driving tool includes a body member, first and second stator magnets at opposed ends of the body with like poles facing one another, a movable magnet (traveler), a coupling adjacent each stator coupled to a user-operable linkage, a hammer, and a spring. In use, the traveler begins magnetically coupled to the first stator and engaged with the first coupling; the hammer holds a fastener. A user operates the linkage, rotating the traveler until its and the first stator's polarity match. The first stator magnetically repulses the traveler, which propels the hammer to insert the fastener and moves to the second stator where it engages the second coupling. The user operates the linkage, causing the traveler to rotate until its and the second stator's polarity match. The second stator then magnetically repulses the traveler, which engages the spring and reaches the first stator, returning to the initial configuration.

19 Claims, 6 Drawing Sheets

MAGNETICALLY OPERATED DRIVING TOOL

BACKGROUND OF THE INVENTION

This invention relates generally to driving tools and, more particularly, to a magnetically operated driving tool that does not require electric energy.

Driving fasteners such as nails, rivets, or staples is one of the most important tasks a tool can accomplish. The nail-gun, more than any other tool, is responsible for the accelerating pace and profitability of house building. Recently, many "in home" and cordless versions of tools have appeared. These devices are smaller and lighter than their industrial counterparts, yet they perform the same functions.

Various devices utilizing magnetic force as a method for propulsion have been proposed in the art. Solenoids use this force directly, as do all electric motors. In both of these cases, however, at least one of the magnets is an electric magnet. Examples of devices that use electricity with magnets for propulsion can be found in U.S. Pat. No. 3,899,703 and U.S. Pat. No. 6,232,689.

Similarly, using magnetic force to power a nail-gun is known in the art, such as in U.S. Pat. No. 4,183,453, U.S. Pat. No. 4,611,742, and U.S. Pat. No. 6,364,193. However, these devices all require an electric power source. This means that they must be corded, making them cumbersome to use and reducing their mobility, or battery operated. Batteries only provide power for a limited time, are expensive, and can leak, which causes safety concerns and can potentially ruin the tools.

Other devices are known that use magnetic force for propulsion without electricity, such as in U.S. Pat. No. 3,609,425 and U.S. Pat. No. 6,433,452, but these devices are ill suited for driving tools. U.S. Pat. No. 3,609,425 requires driven magnets that selectively intercept the established magnetic fields and drive a reciprocating magnet to its alternate position; these driven magnets would make a hand-held driving tool bulky and cumbersome to use, and it is unclear that this device would supply sufficient instantaneous force to drive a fastener. U.S. Pat. No. 6,433,452 does not deliver a single burst of propulsion as is needed for a driving tool; instead, a rotatable balance wheel rotates continuously to maintain rotation of an output shaft.

Therefore, it is desirable to have a magnetically operated driving tool that provides sufficient instantaneous force to drive a fastener, does not require electric energy, is light, compact, and easy to use, and can be easily manufactured.

SUMMARY OF THE INVENTION

A magnetically operated driving tool for use in inserting fasteners according to the present invention includes a body member having a generally tubular configuration, first and second stationary (stator) magnets mounted in a spaced apart relationship at opposed ends of the body member with like poles facing one another, a movable magnet freely positioned in the body member for magnetically induced movement between the stator magnets, a coupling positioned adjacent each respective stator magnet for engaging the movable magnet when the movable magnet is magnetically coupled to the respective stator magnet, a user-operable linkage coupled to the couplings for selectively rotating the movable magnet until the polarity of the movable magnet is the same as the polarity of the respective stator magnet, a hammer slidably mounted in the body member, and a spring positioned in the body member.

In use, the movable magnet is initially magnetically coupled to the first stator magnet and engaged with the first coupling, and a fastener is held by the hammer. A user then operates the linkage, causing the movable magnet to rotate until its polarity is the same as the polarity of the first stator magnet. The movable magnet is then magnetically repulsed from the first stator magnet and moves to the second stator magnet. Before reaching the second stator magnet, the movable magnet propels the hammer from a retracted configuration to an extended configuration, thus inserting the fastener. When the movable magnet reaches the second stator magnet, it is magnetically coupled to the second stator magnet and engaged with the second coupling. The user again operates the linkage, causing the movable magnet to rotate until its polarity is the same as the polarity of the second stator magnet. The movable magnet is then magnetically repulsed from the second stator magnet and moves to the first stator magnet. Before reaching the first stator magnet, the movable magnet engages the spring, which stores the energy of the moving magnet and dampens the blow of the moving magnet. When the movable magnet reaches the first stator magnet, it is magnetically coupled to the first stator magnet and engaged with the first coupling, returning the magnetically operated driving tool to its initial configuration.

Therefore, a general object of this invention is to provide a magnetically operated driving tool that provides sufficient instantaneous force to drive a fastener.

Another object of this invention is to provide a magnetically operated driving tool, as aforesaid, that does not require electricity.

Still another object of this invention is to provide a magnetically operated driving tool, as aforesaid, that is light and compact.

Yet another object of this invention is to provide a magnetically operated driving tool, as aforesaid, that is easy to use.

A further object of this invention is to provide a magnetically operated driving tool, as aforesaid, that is easily and cost-effectively manufactured.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
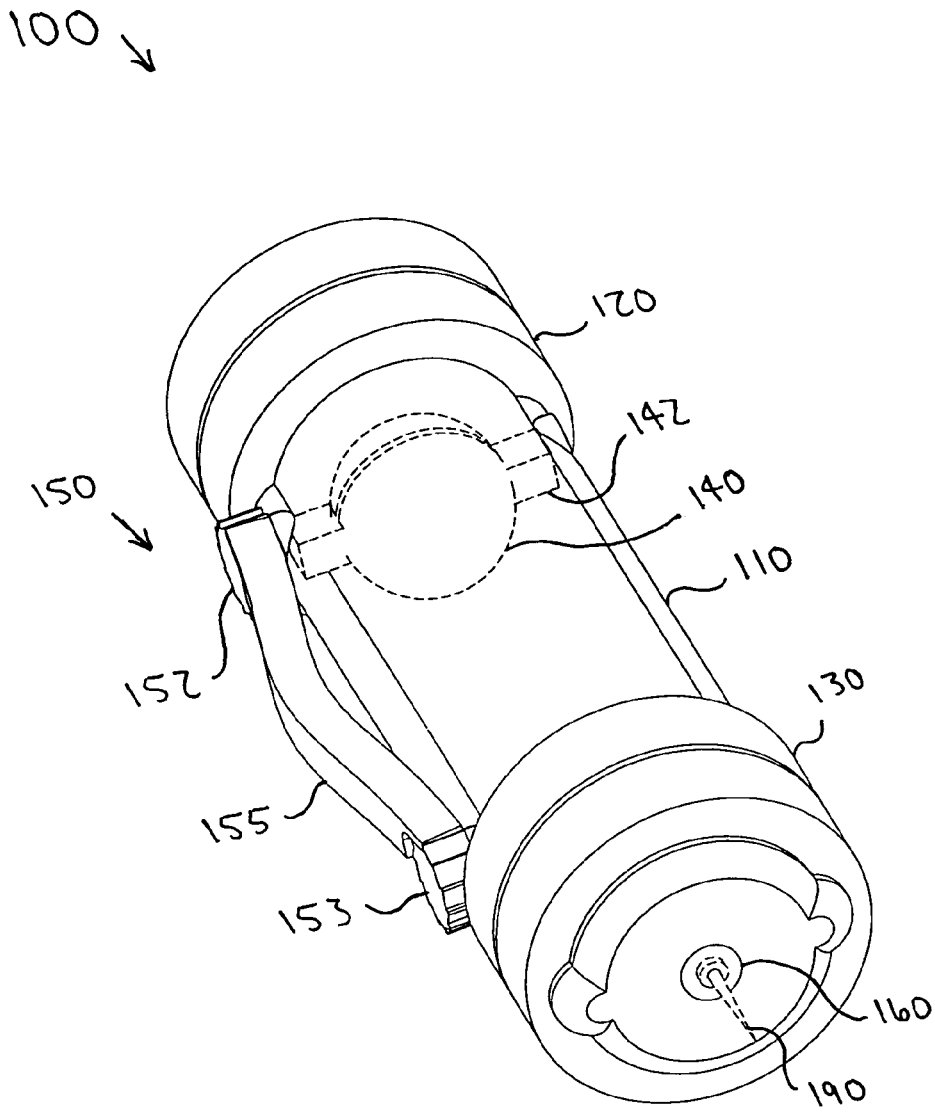
FIG. 1 is a front perspective view of a magnetically operated driving tool according to a now preferred embodiment of the present invention with a fastener.
Figure 2:
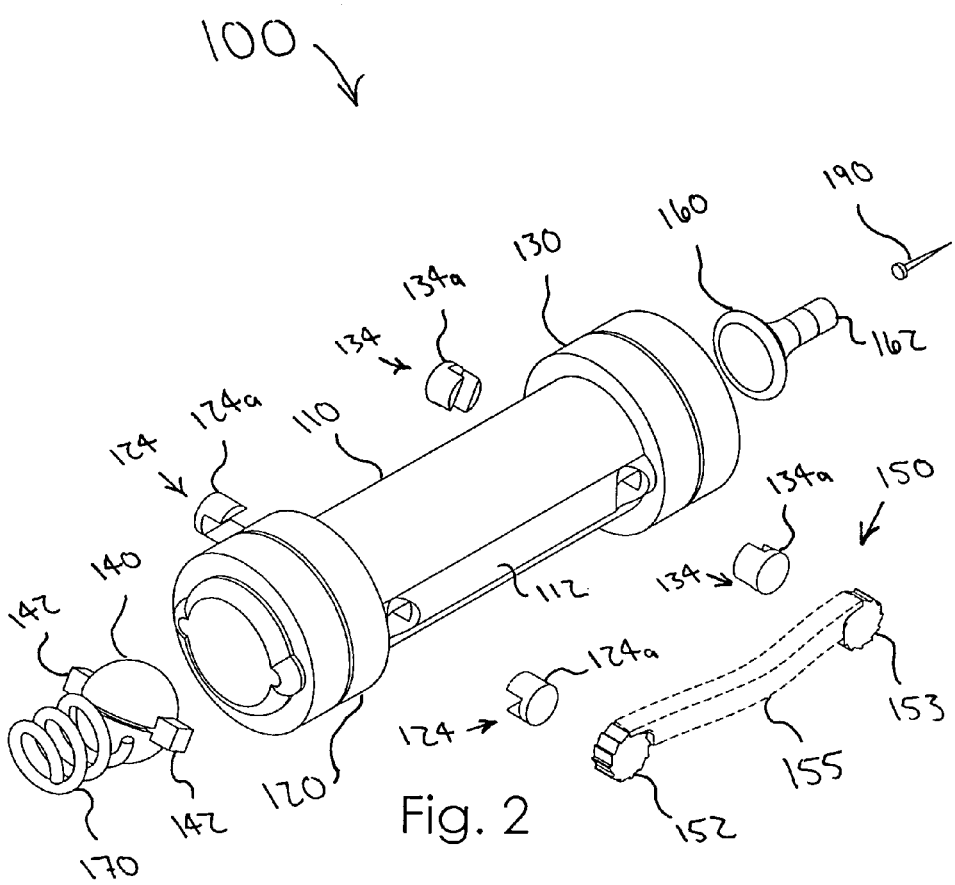
FIG. 2 is an exploded view of the magnetically operated driving tool as in FIG. 1 with a fastener.
Figure 3A:
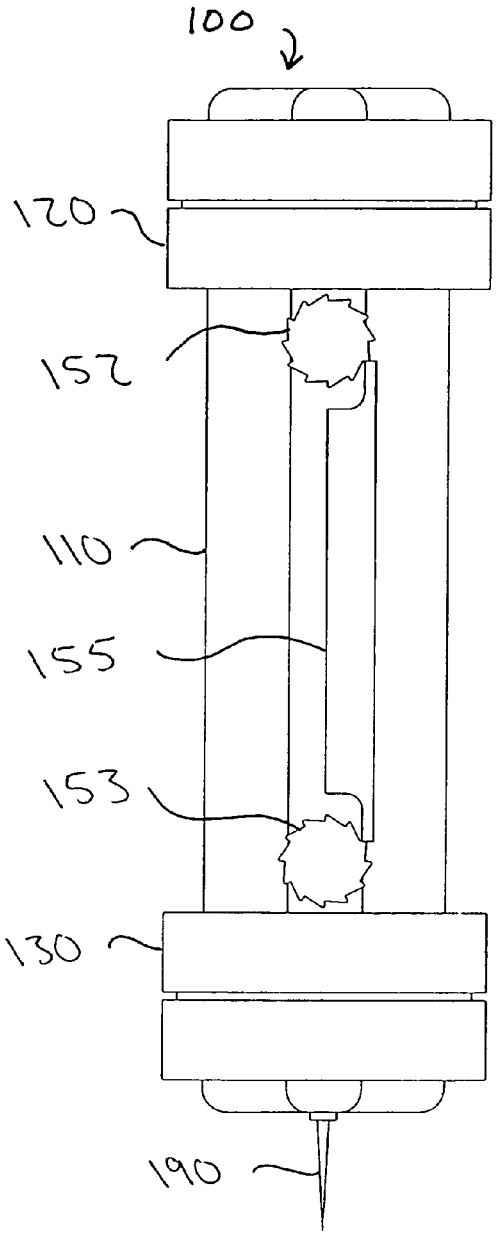
FIGS. 3*a* and 3*b* are top and side views, respectively, of the magnetically operated driving tool as in FIG. 1 with a fastener and with the handle released.
Figure 3B:
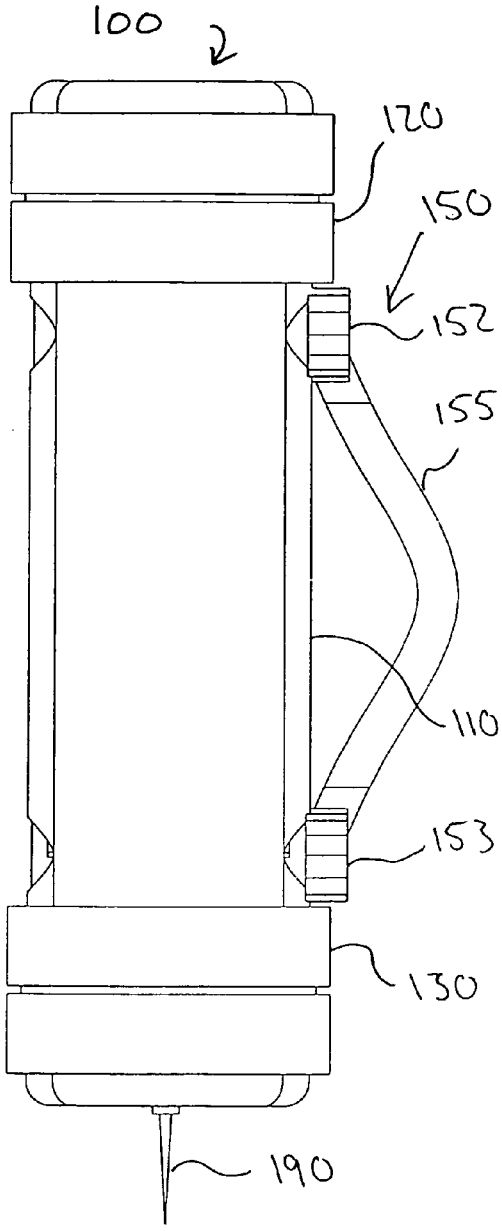

A magnetically operated driving tool according to the present invention will now be described in detail with reference to FIGS. 1 through 6*c* of the accompanying drawings. More particularly, a magnetically operated driving tool 100 according to a now preferred embodiment includes a body member 110 having a generally tubular configuration, first and second stationary (stator) magnets 120, 130 mounted in a spaced apart relationship at opposed ends of the body member 110 with like poles facing one another, and a moveable magnet 140 positioned in the body member 110 for magnetically induced movement between the stator magnets 120, 130 (FIGS. 1 and 2). Preferably, the stator magnets 120, 130 have generally ring-shaped configurations such that the movable magnet 140 may pass therethrough for engagement with other components as will be further described later. First and second couplings 124, 134 are positioned in the body member 110 adjacent the first and second stator magnets 120, 130, respectively, for engaging the movable magnet 140 when the movable magnet 140 is magnetically coupled to the respective stator magnet 120, 130. A user-operable linkage 150 is connected to the couplings 124, 134 for selectively rotating the movable magnet 140 until the polarity of the movable magnet 140 is the same as the polarity of the nearest respective stator magnet 120, 130.

The body member 110 preferably includes a channel 112 extending longitudinally between the first and second stator magnets 120, 130, and the first and second couplings 124, 134 are preferably first and second slotted nuts 124*a*, 134*a* rotatably mounted in the channel 112. Other couplings can be used, however. The movable magnet 140 preferably includes a flange 142 configured for sliding along the channel 112 and nesting in the respective slotted nuts 124*a*, 134*a*. The slotted nuts 124*a*, 134*a* can be best seen in FIG. 2 and FIGS. 6*a* through 6*c*.

Figure 4A:
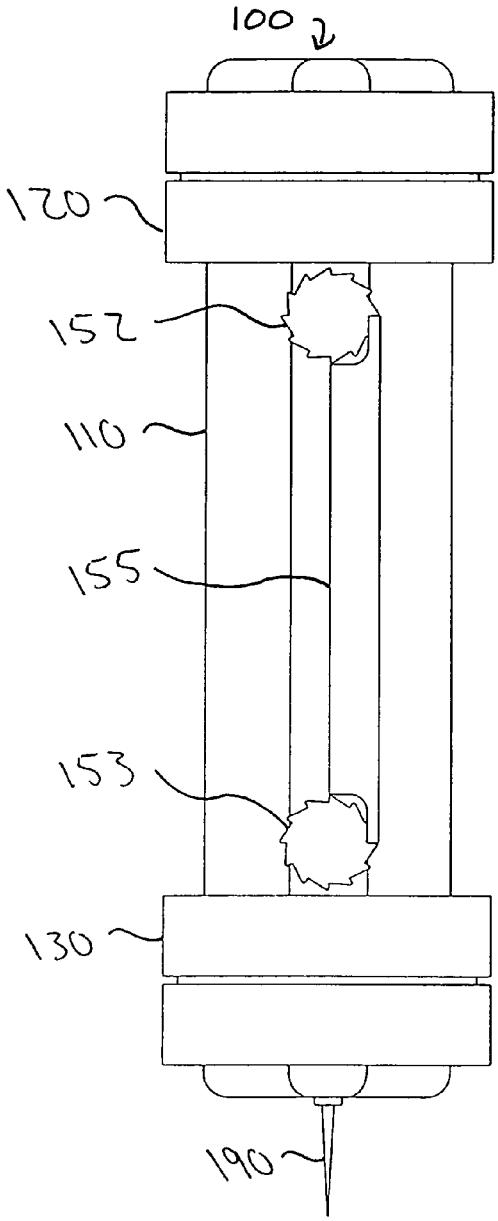
FIGS. 4*a* and 4*b* are top and side views, respectively, of the magnetically operated driving tool as in FIG. 1 with a fastener and with the handle squeezed.
Figure 4B:
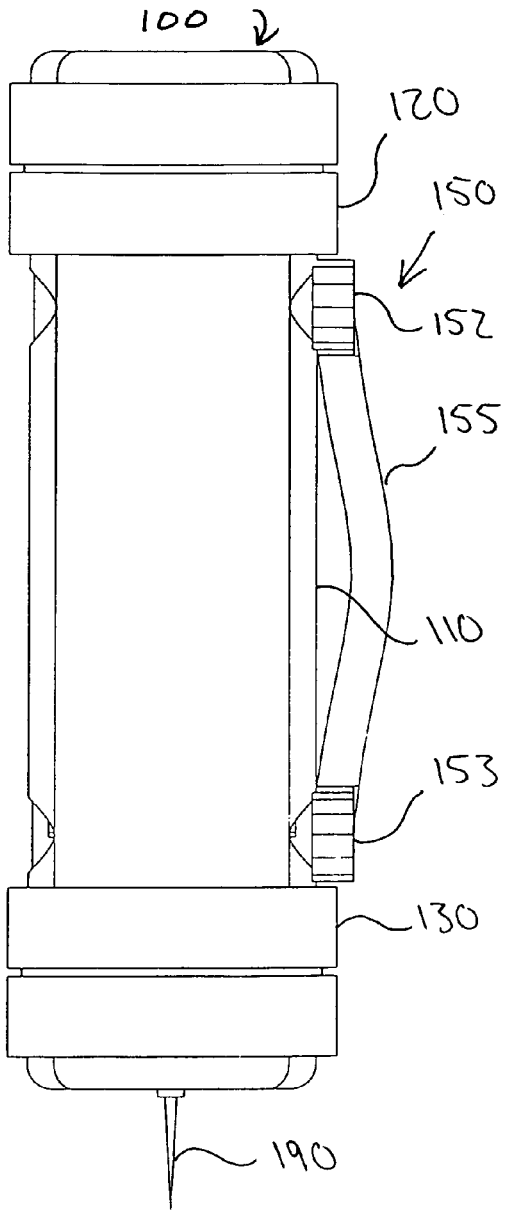
Figure 6A:
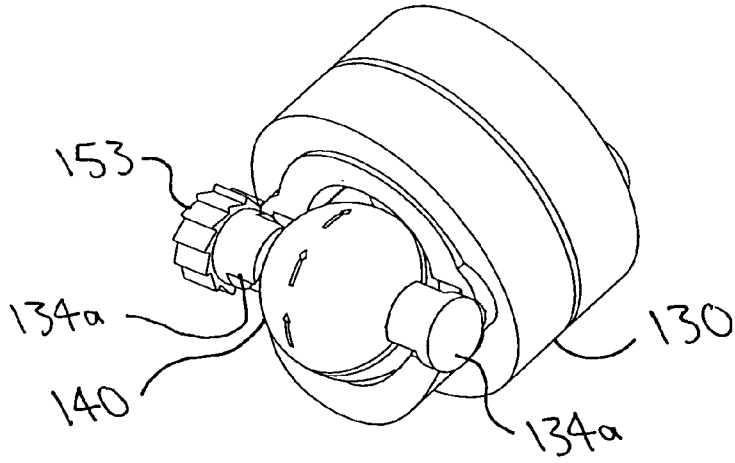
FIG. 6*a* is an isolated perspective view showing the rotation of a movable magnet.
Figure 6B:
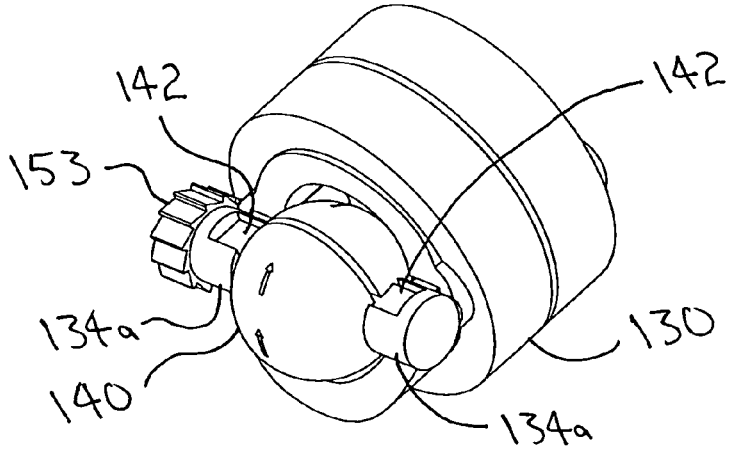
FIG. 6*b* is an isolated perspective view further showing the rotation of a movable magnet.
Figure 6C:
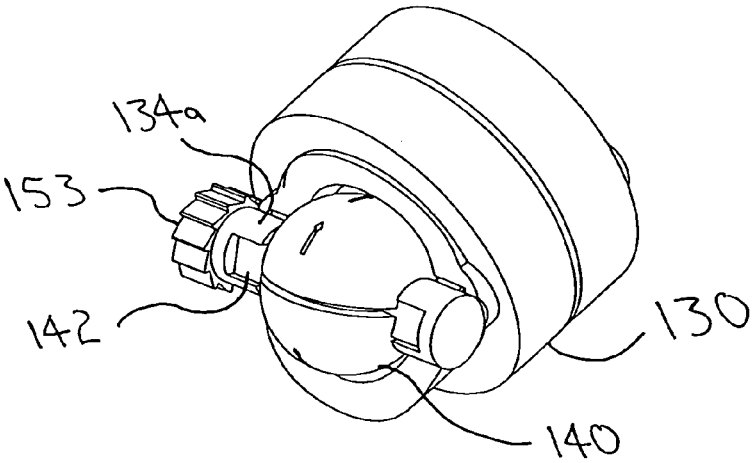
FIG. 6*c* is an isolated perspective view still further showing the rotation of a movable magnet.
Figure 1:
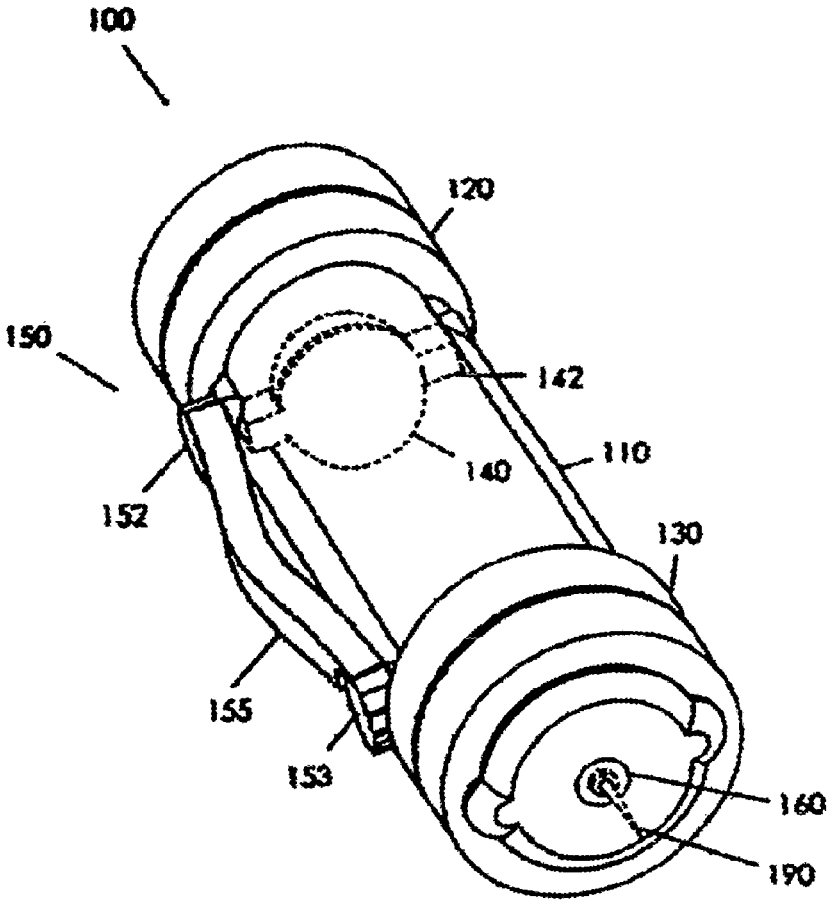
Figure 2:
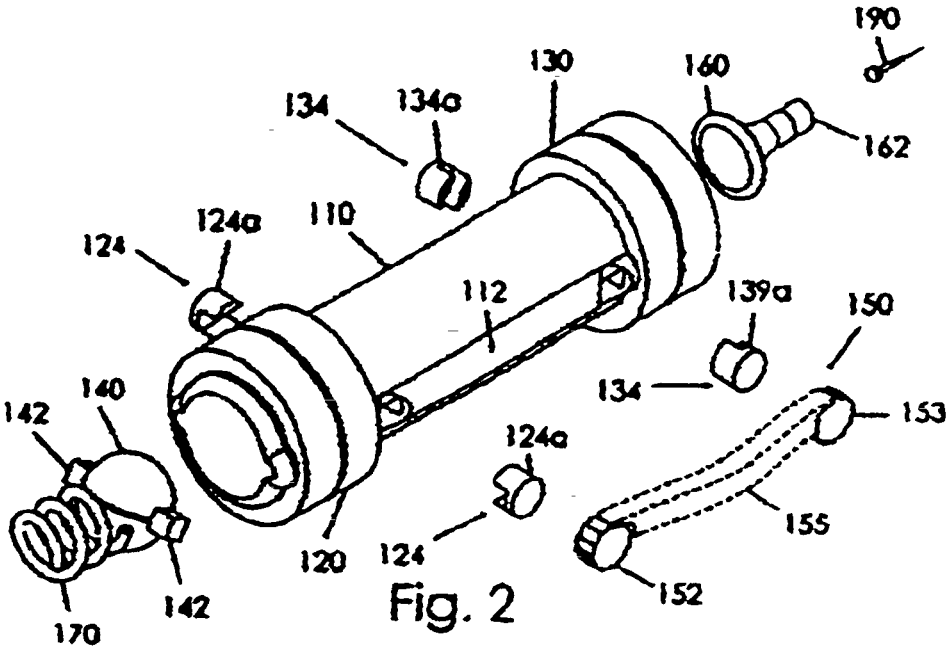
Figure 3A:
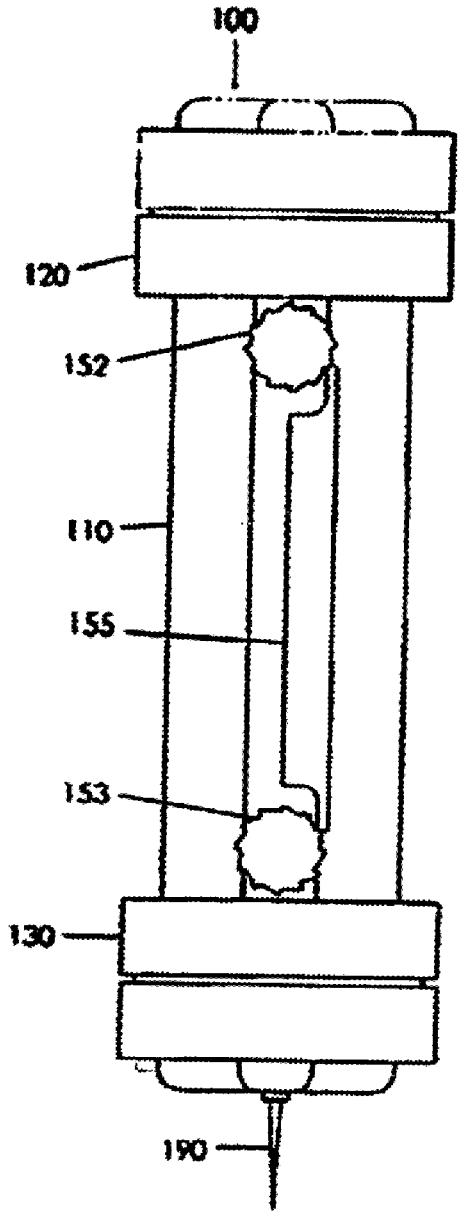
Figure 3B:
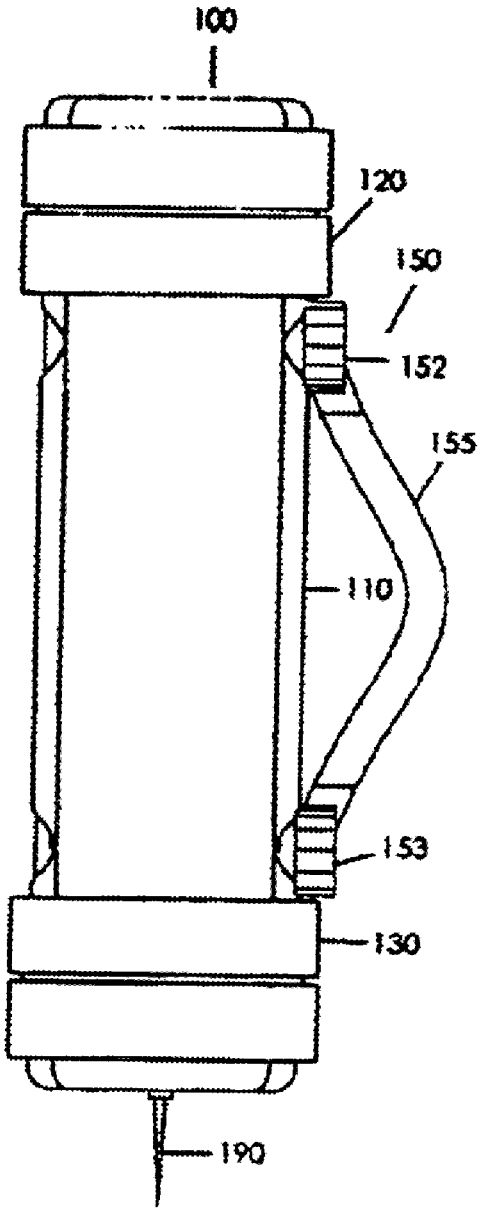

The user-operable linkage 150 preferably includes a first ratchet 152 operatively connected to the first coupling 124, a second ratchet 153 operatively connected to the second coupling 134, and a handle 155 made of a resilient material operatively connecting the two ratchets 152, 153 (FIG. 2). When the handle 155 is squeezed (FIGS. 4*a* and 4*b*), the handle 155 rotates the ratchets 152, 153, causing the couplings 124, 134 to rotate. The rotation of the couplings 124, 134 causes the movable magnet 140 to rotate (FIGS. 6*a*–6*c*). When the handle 155 is released, it returns to its initial position (FIGS. 3*a* and 3*b*) due to the handle's resilient material construction. Depending on the number of teeth on the ratchets 152, 153, it may take four to six squeezes of the handle 155 to rotate the movable magnet 140 one hundred and eighty degrees. Of course, other linkages would also be suitable (not shown). For example, sprockets could be operatively connected to the couplings 124, 134, and a chain would be used to connect the sprockets. A sprocket could then be rotated in a conventional manner to rotate both couplings 124, 134. This same basic linkage could also be accomplished using pulleys and a belt or a gear train (not shown). These alternatives are relatively bulky, however, which reduces the compact character of the present invention. As another example, a linkage could connect the couplings 124, 134, and a lever could be used to rotate the couplings 124, 134. This could create a mechanical advantage to magnify the user's input of force. Other suitable linkages may be used as well as the above examples are only illustrative.

Figure 5A:
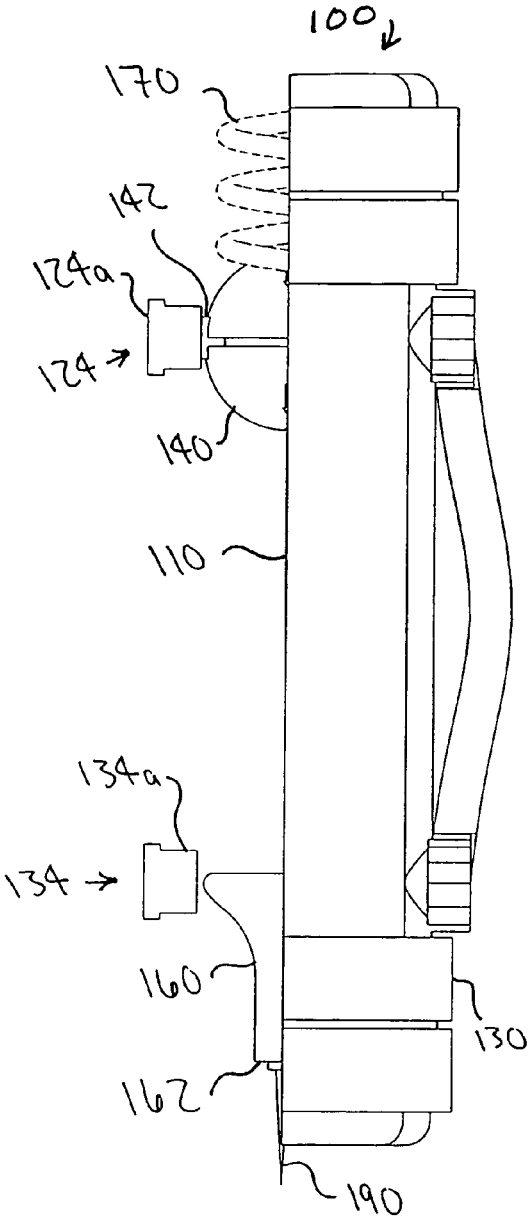
FIGS. 5*a* and 5*b* are partial side views of the magnetically operated driving tool as in FIG. 1 with a fastener, showing the movement of a movable magnet from a first stator magnet to a second stator magnet.
Figure 5B:
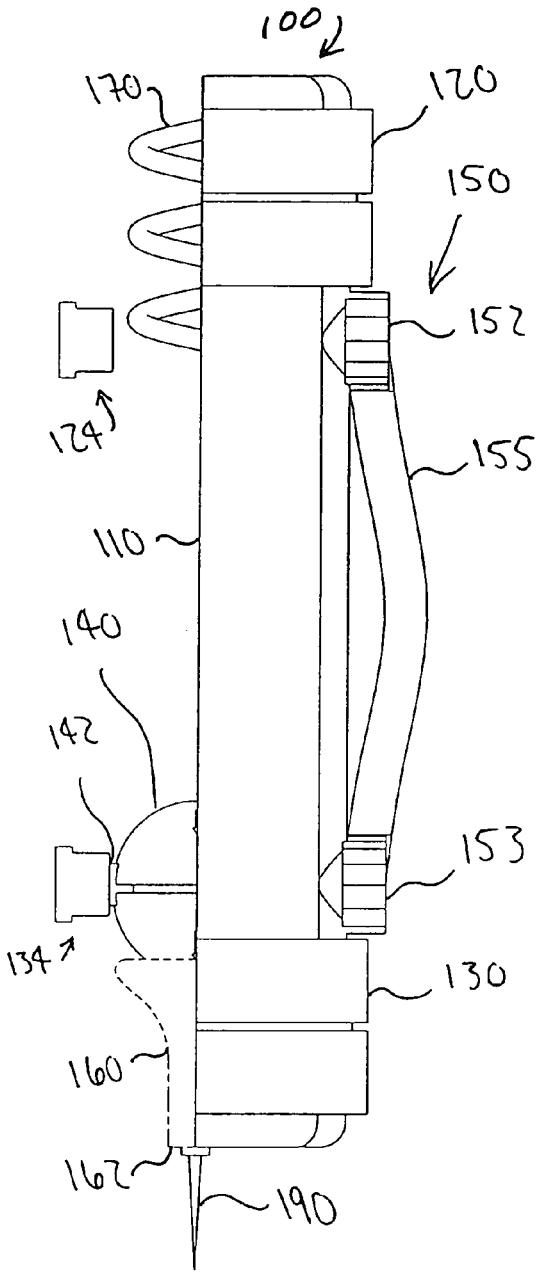

A hammer 160 is slidably mounted in the body member 110 proximate the second stator magnet 130 such that the movable magnet 140 propels the hammer 160 from a retracted configuration to an extended configuration when the movable magnet 140 travels from the first stator magnet 120 (FIG. 5*a*) to the second stator magnet 130 (FIG. 5*b*). The hammer 160 preferably includes a magnetized tip 162 capable of holding a metal fastener 190 by magnetic attraction, and a magnetic attraction preferably exists between the magnetized tip 162 and the second stator magnet 130 such that the hammer 160 is normally biased to the retracted configuration. Further, the polarity of the magnetized tip 162 is the same as the polarity of the movable magnet 140 when the movable magnet 140 travels from the first stator magnet 120 to the second stator magnet 130, thus repulsing the hammer 160. The magnetized tip 162 allows any type of metal fastener 190 with a head to be used unlike traditional nail guns, which only fire specially prepared nails. Nevertheless, the hammer 160 does not have to include a magnetized tip 162, as the hammer 160 could include a special fastener holder that is not magnetized. This special fastener holder would be required for fasteners without heads, such as finish nails and brads.

A spring 170 is positioned in the body member 110 proximate the first stator magnet 120 such that the movable magnet 140 engages the spring 170 when the movable magnet 140 travels from the second stator magnet 130 to the first stator magnet 120. This construction is illustrated in FIGS. 2, 5*a*, and 5*b*. Though the spring 170 is beneficial (as described below,) it is not essential for the preferred operation of the present invention.

In use, the magnetically operated driving tool 100 begins in an initial configuration with the movable magnet 140 magnetically coupled to the first stator magnet 120 and the hammer 160 in the retracted configuration. A user then introduces a fastener 190, which is held by the hammer 160 (FIG. 1). The user then operates the linkage 150, causing the movable magnet 140 to rotate as described above (FIGS. 3*a* to 4*b* and FIGS. 6*a*–6*c*) until its polarity is the same as the polarity of the first stator magnet 120. The movable magnet 140 is then magnetically repulsed from the first stator magnet 120 and released from the first coupling 124, causing the movable magnet 140 to travel to the second stator magnet 130, it being understood that the path of the movable magnet 140 is guided by the flange 142 traveling along the channel 112. The spring 170 also releases potential energy to further power the movable magnet 140 in its travel from the first stator magnet 120 to the second stator magnet 130, and the second stator magnet 130 exerts an attractive force on the movable magnet 140 to even further power the movable magnet 140 in its travel. Before the movable magnet 140 reaches the second stator magnet 130, the movable magnet 140 propels the hammer 160 from the retracted configuration to the extended configuration, thus inserting the fastener 190. When the movable magnet 140 reaches the second stator magnet 130, the movable magnet 140 is magnetically coupled to the second stator magnet 130 and engaged with the second coupling 134. The movement of the movable magnet 140 from the first stator magnet 120 to the second stator magnet 130 is shown in FIGS. 5*a* and 5*b*. The user again operates the linkage 150, causing the movable magnet 140 to rotate until its polarity is the same as the polarity of the second stator magnet 130. The movable magnet 140 is then magnetically repulsed from the second stator magnet 130 and released from the second coupling 134, causing the movable magnet 140 to travel to the first stator magnet 120. The first stator magnet 120 exerts an attractive force on the movable magnet 140 to further power the movable magnet 140 in its travel from the second stator magnet 130 to the first stator magnet 120. Before the movable magnet 140 reaches the first stator magnet 120, the movable magnet 140 engages the spring 170. The spring 170 dampens the blow of the movable magnet 140 and stores kinetic energy from the movable magnet 140 as potential energy. When the movable magnet 140 reaches the first stator magnet 120, the movable magnet 140 is magnetically coupled to the first stator magnet 120 and engaged with the first coupling 124, returning the magnetically operated driving tool 100 to its initial configuration.

A magnetically operated driving tool (not shown) according to another embodiment of the present invention includes a construction substantially similar to the construction previously described except as specifically noted below. More particularly, the magnetically operated driving tool according to this embodiment includes conventional methods for rotating the couplings 124, 134 individually instead of employing the user-operable linkage 150.

It is understood that while certain forms of this invention have been illustrated and described, it is not limited thereto except insofar as such limitations are included in the following claims and allowable functional equivalents thereof. It is also specifically understood that the principles of this invention have been specifically applied to nail guns, they may also be applied to many other driving tools or assemblies.

What is claimed is:

1. A magnetically operated driving tool, comprising:

a body member having a generally tubular configuration;

first and second stator magnets mounted in a spaced apart relationship at opposed ends of said body member, said first and second stator magnets configured with like poles facing one another;

a movable magnet freely positioned in said body member for magnetically induced movement between said first and second stator magnets, a pole of said movable magnet being magnetically attracted toward an opposite pole of a respective stator magnet;

a first coupling positioned adjacent said first stator magnet for engaging said movable magnet when said movable magnet is magnetically coupled thereto; and a user-operable linkage coupled to said first coupling for selectively rotating said movable magnet until the polarity of said movable magnet is the same as the polarity of said first stator magnet and said movable magnet is repulsed from said first stator magnet to said second stator magnet.

2. The magnetically operated driving tool as in claim 1 wherein:

said body member includes a channel extending longitudinally between said first and second stator magnets;

said first coupling is a first slotted nut rotatably mounted in said channel; and said movable magnet includes a flange configured for sliding along said channel and nesting in said first slotted nut.

3. The magnetically operated driving tool as in claim 1 further comprising:

a second coupling positioned adjacent said second stator magnet for engaging said movable magnet when said movable magnet is magnetically coupled thereto; and wherein said linkage is coupled to said second coupling for selectively rotating said movable magnet until the polarity of said movable magnet is the same as the polarity of said second stator magnet and said movable magnet is repulsed therefrom;

said body member includes a channel extending longitudinally between said first and second stator magnets;

said first coupling is a first slotted nut rotatably mounted in said channel;

said second coupling is a second slotted nut rotatably mounted in said channel; and said movable magnet includes a flange configured for sliding along said channel and nesting in said first and second slotted nuts.

4. The magnetically operated driving tool as in claim 1 further comprising:

a second coupling positioned adjacent said second stator magnet for engaging said movable magnet when said movable magnet is magnetically coupled thereto; and wherein said linkage is coupled to said second coupling for selectively rotating said movable magnet until the polarity of said movable magnet is the same as the polarity of said second stator magnet and said movable magnet is repulsed therefrom.

5. The magnetically operated driving tool as in claim 4 wherein:

said first coupling is a first slotted nut rotatably mounted in said body member; and said second coupling is a second slotted nut rotatably mounted in said body member.

6. The magnetically operated driving tool as in claim 4 further comprising a hammer slidably mounted in said body member and proximate to said second stator magnet such that said movable magnet propels said hammer from a retracted configuration to an extended configuration when said movable magnet moves from said first stator magnet to said second stator magnet.

7. The magnetically operated driving tool as in claim 6 wherein:

said hammer includes a magnetized tip for magnetically holding a metal fastener;

wherein said magnetized tip is magnetically attracted to said second stator magnet for normally biasing said hammer to said retracted configuration; and wherein the polarity of said magnetized tip is the same as the polarity of said movable magnet such that said magnetized tip is repulsed therefrom when said movable magnet moves from said first stator magnet to said second stator magnet.

8. The magnetically operated driving tool as in claim 4 further comprising a spring positioned in said body member proximate said first stator magnet such that said movable magnet engages said spring when said movable magnet moves from said second stator magnet to said first stator magnet.

9. The magnetically operated driving tool as in claim 4 wherein said linkage includes:

a handle made of a resilient material; and two ratchets operatively connected to said first and second coupling, respectively, and said handle, such that squeezing said handle causes said ratchets to rotate and said first and second couplings to rotate.

10. A magnetically operated driving tool, comprising:

a body member having a generally tubular configuration;

first and second stator magnets mounted in a spaced apart relationship at opposed ends of said body member, said first and second stator magnets configured with like poles facing one another;

a movable magnet freely positioned in said body member for magnetically induced movement between said first and second stator magnets, a pole of said movable magnet being magnetically attracted toward an opposite pole of a respective stator magnet;

means positioned adjacent a respective stator magnet for capturing said movable magnet when said movable magnet is magnetically coupled to said respective stator magnet; and means for turning said captured movable magnet until the polarity of said captured movable magnet is the same as the polarity of said respective stator magnet and said movable magnet is repulsed from said respective stator magnet.

11. The magnetically operated driving tool as in claim 10 wherein:

said body member includes a channel extending longitudinally between said first and second stator magnets;

said movable magnet includes a flange configured for sliding along said channel; and said means for capturing said movable magnet when said movable magnet is magnetically coupled to said respective stator magnet is a first slotted nut rotatably mounted in said channel adjacent said first stator magnet and a second slotted nut rotatably mounted in said channel adjacent said second stator magnet, whereby said flange nests in said first or second slotted nut.

12. The magnetically operated driving tool as in claim 11 wherein said means for turning said captured movable magnet includes:

a handle made of a resilient material; and two ratchets operatively connected to said first and second slotted nuts, respectively, and said handle, such that squeezing said handle causes said ratchets to rotate and said first and second slotted nuts to rotate.

13. The magnetically operated driving tool as in claim 10 further comprising a hammer slidably mounted in said body member proximate said second stator magnet such that said movable magnet propels said hammer from a retracted configuration to an extended configuration when said movable magnet moves from said first stator magnet to said second stator magnet.

14. The magnetically operated driving tool as in claim 13 wherein:

said hammer includes a magnetized tip for holding a metal fastener by magnetic attraction;

wherein said magnetized tip is magnetically attracted to said second stator magnet for normally biasing said hammer to said retracted configuration; and wherein the polarity of said magnetized tip is the same as the polarity of said movable magnet such that said magnetized tip is repulsed therefrom when said movable magnet moves from said first stator magnet to said second stator magnet.

15. The magnetically operated driving tool as in claim 14 further comprising a spring positioned in said body member proximate said first stator magnet such that said movable magnet engages said spring when said movable magnet moves from said second stator magnet to said first stator magnet.

16. A magnetically operated driving tool, comprising:

a body member having a generally tubular configuration;

first and second stator magnets mounted in a spaced apart relationship at opposed ends of said body member, said first and second stator magnets configured with like poles facing one another;

a movable magnet freely positioned in said body member for magnetically induced movement between said first and second stator magnets, a pole of said movable magnet being magnetically attracted toward an opposite pole of a respective stator magnet, said movable magnet having a flange fixedly attached thereto;

first and second couplings positioned adjacent said first and second stator magnets, respectively, for engaging said movable magnet when said movable magnet is magnetically coupled thereto; and a user-operable linkage coupled to said first and second couplings for selectively rotating said movable magnet until the polarity of said movable magnet is the same as the polarity of said respective stator magnet and said movable magnet is repulsed therefrom; and wherein said body member includes a channel extending longitudinally between said first and second stator magnets; and said flange is configured for sliding along said channel and nesting in said first and second couplings.

17. The magnetically operated driving tool as in claim 16 further comprising:

a hammer slidably mounted in said body member proimate said second stator magnet such that said movable magnet propels said hammer from a retracted configuration to an extended configuration when said movable magnet moves from said first stator magnet to said second stator magnet; and a spring positioned in said body member proximate said first stator magnet such that said movable magnet engages said spring when said movable magnet moves from said second stator magnet to said first stator magnet.

18. The magnetically operated driving tool as in claim 17 wherein:

said hammer includes a magnetized tip such that a metal fastener can be held by magnetic force;

wherein said magnetized tip is magnetically attracted to said second stator magnet for normally biasing said hammer to said retracted configuration; and wherein the polarity of said magnetized tip is the same as the polarity of said movable magnet such that said magnetized tip is repulsed therefrom when said movable magnet moves from said first stator magnet to said second stator magnet.

19. The magnetically operated driving tool as in claim 18 wherein:

said first coupling is a first slotted nut rotatably mounted in said channel;

said second coupling is a second slotted nut rotatably mounted in said channel; and said linkage includes a handle made of a resilient material and two ratchets operatively connected to said handle and said first and second slotted nuts, respectively, such that squeezing said handle causes said two ratchets to rotate and said first and second slotted nuts to rotate.

* * * * *

UNITED STATES PATENT AND TRADEMARK OFFICE

CERTIFICATE OF CORRECTION

PATENT NO. : 6,955,282 B1 
APPLICATION NO. : 10/833230
DATED : October 18, 2005
INVENTOR(S) : David W. Kimple It is certified that error appears in the above-identified patent and that said Letters Patent is hereby corrected as shown below:

On the cover page, replace the informal drawing with the formal drawing of Fig 1.

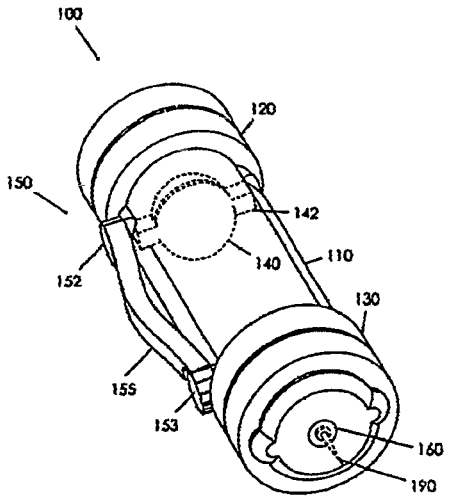

On drawing Sheet 1 of 6, replace the informal drawing of Fig 1 with the formal drawing of Fig 1.

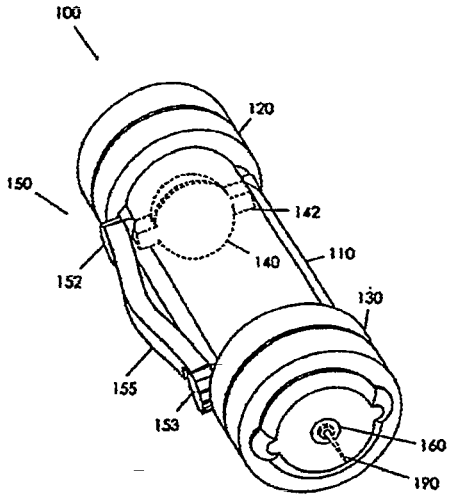

Fig. 1

UNITED STATES PATENT AND TRADEMARK OFFICE

CERTIFICATE OF CORRECTION

PATENT NO. : 6,955,282 B1 
APPLICATION NO. : 10/833230
DATED : October 18, 2005
INVENTOR(S) : David W. Kimple It is certified that error appears in the above-identified patent and that said Letters Patent is hereby corrected as shown below:

On drawing Sheet 2 of 6, replace the informal drawing of Fig 2 with the formal drawing of Fig 2.

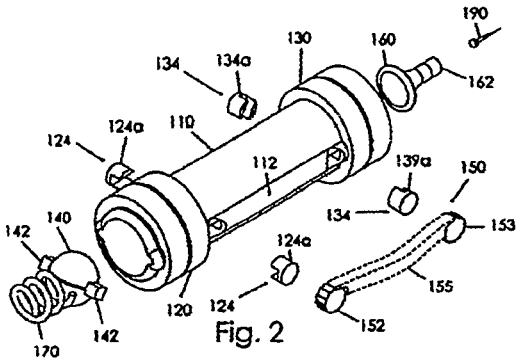

Fig. 2

On drawing Sheet 3 of 6, replace the informal drawing of Fig 3 with the formal drawing of Fig 3.

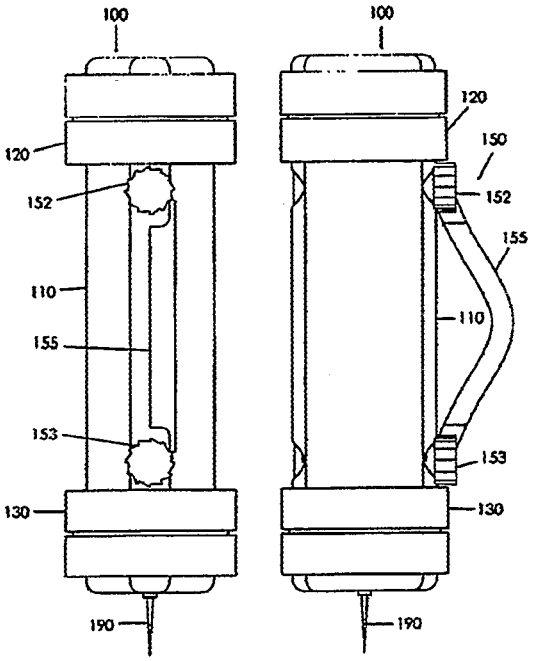

Fig. 3

UNITED STATES PATENT AND TRADEMARK OFFICE

CERTIFICATE OF CORRECTION

Figure 4:
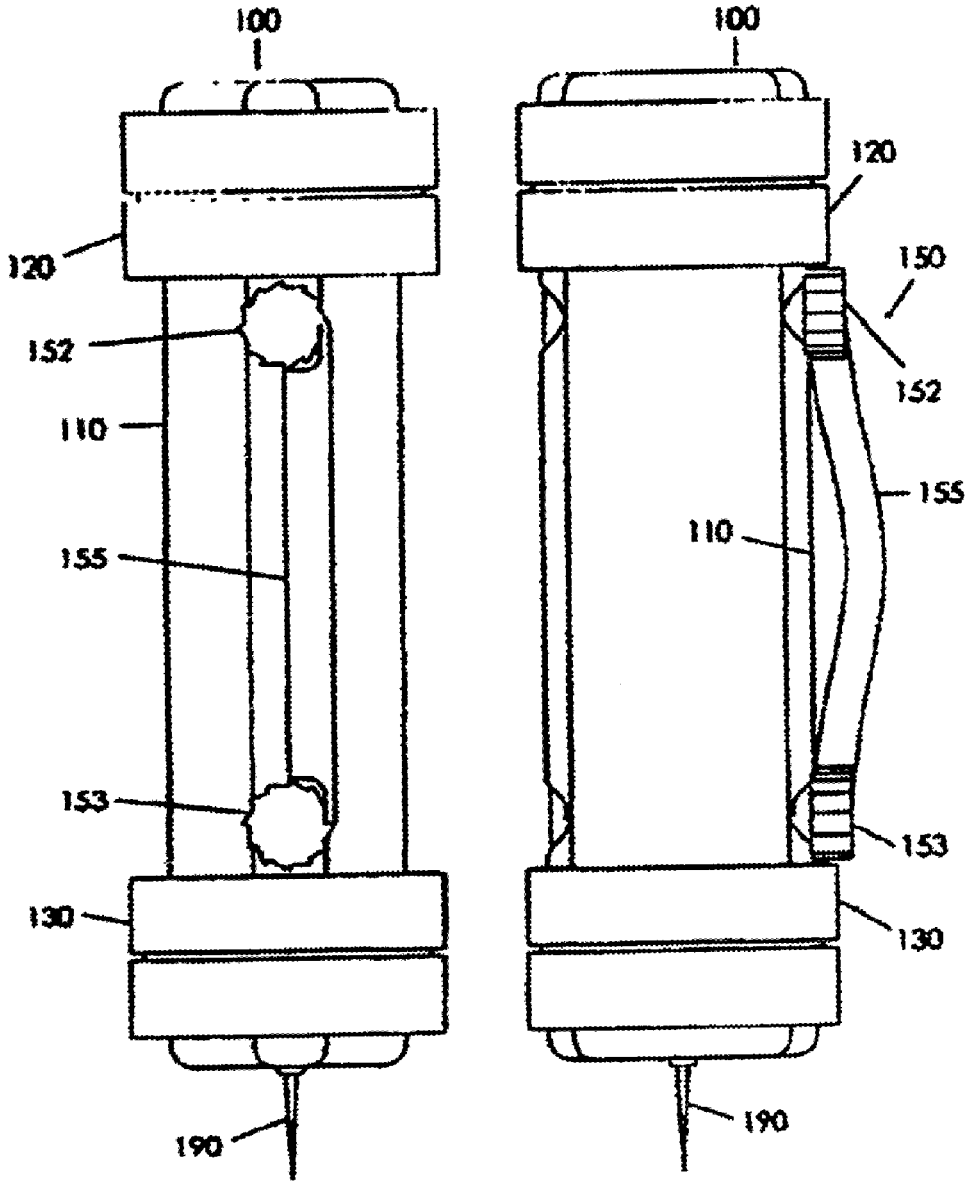

PATENT NO. : 6,955,282 B1 
APPLICATION NO. : 10/833230
DATED : October 18, 2005
INVENTOR(S) : David W. Kimple It is certified that error appears in the above-identified patent and that said Letters Patent is hereby corrected as shown below:

On drawing Sheet 4 of 6, replace the informal drawing of Fig 4 with the formal drawing of Fig 4.

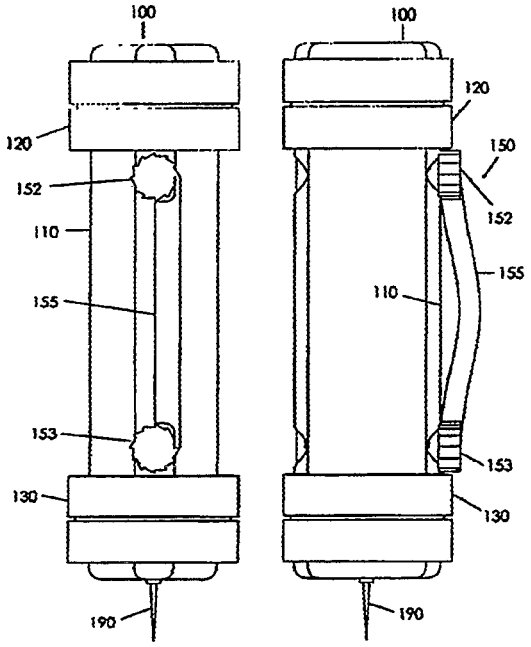

Fig. 4

UNITED STATES PATENT AND TRADEMARK OFFICE

CERTIFICATE OF CORRECTION

Figure 5:
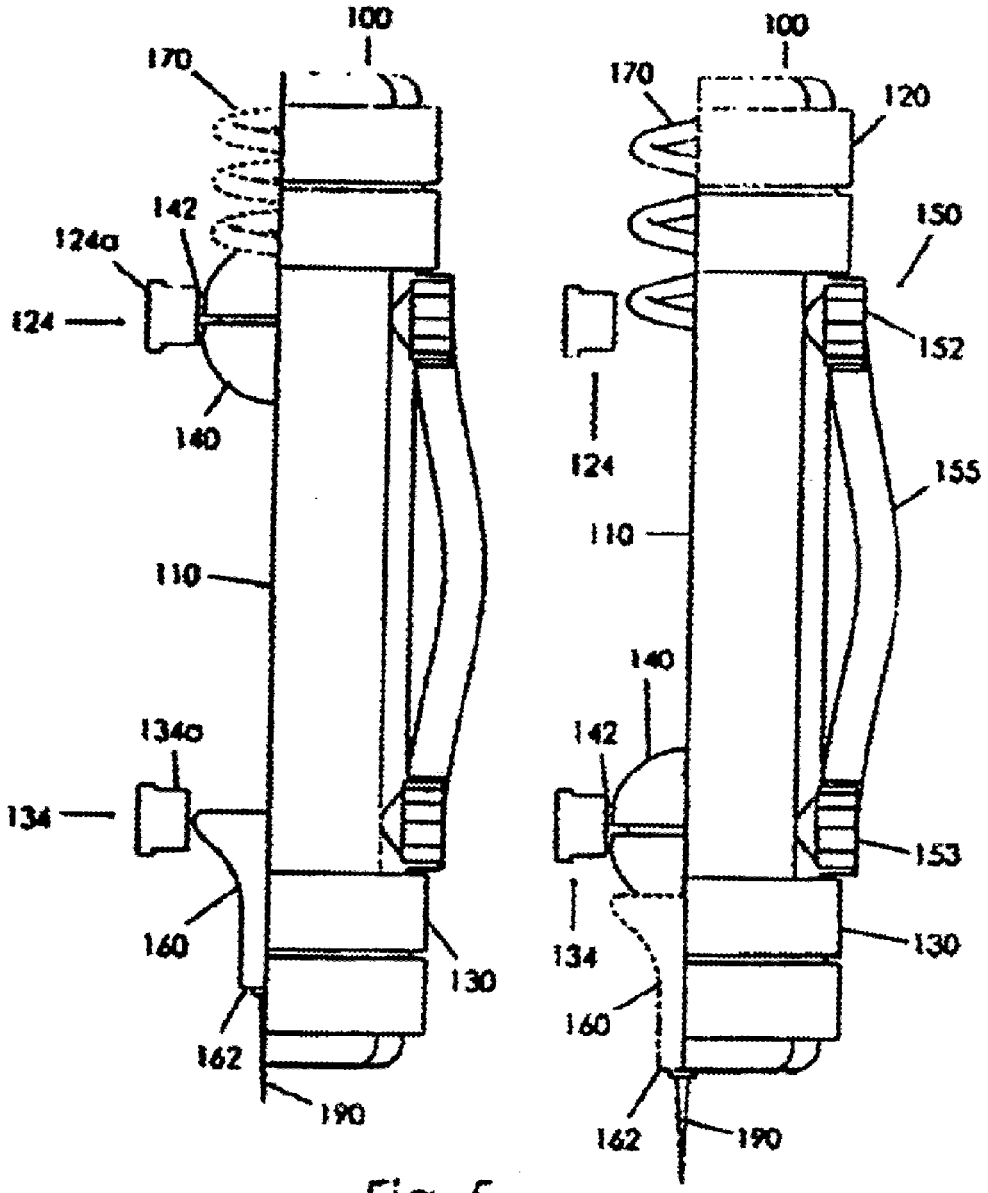
Figure 6A:
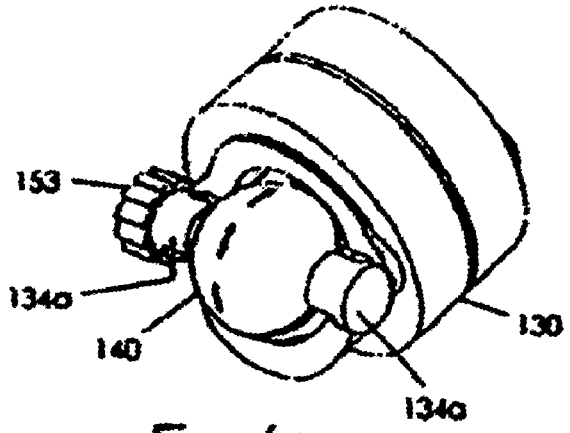
Figure 6B:
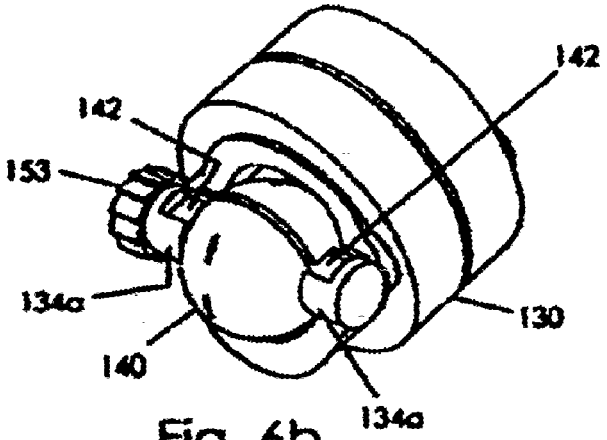
Figure 6C:
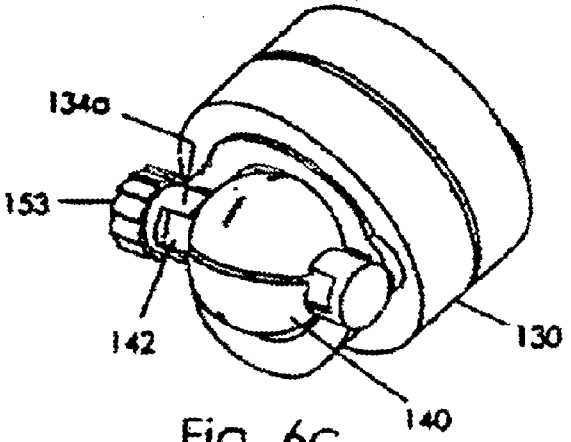

PATENT NO. : 6,955,282 B1 
APPLICATION NO. : 10/833230
DATED : October 18, 2005
INVENTOR(S) : David W. Kimple It is certified that error appears in the above-identified patent and that said Letters Patent is hereby corrected as shown below:

On drawing Sheet 5 of 6, replace the informal drawing of Fig 5 with the formal drawing of Fig 5.

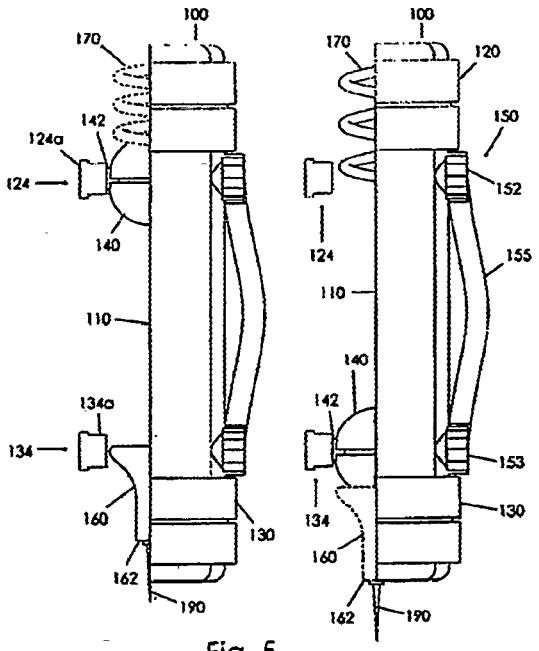

Fig. 5

UNITED STATES PATENT AND TRADEMARK OFFICE

CERTIFICATE OF CORRECTION

PATENT NO. : 6,955,282 B1 
APPLICATION NO. : 10/833230
DATED : October 18, 2005
INVENTOR(S) : David W. Kimple It is certified that error appears in the above-identified patent and that said Letters Patent is hereby corrected as shown below:

On drawing Sheet 6 of 6, replace the informal drawings of Fig 6a, Fig 6b, and Fig. 6c with the formal drawings of Fig. 6a, Fig 6b,and Fig 6c.

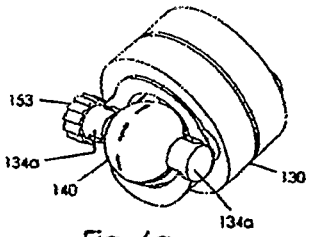

Fig. 6a

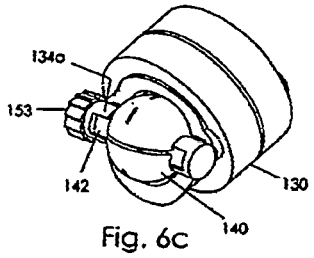

Fig. 6c

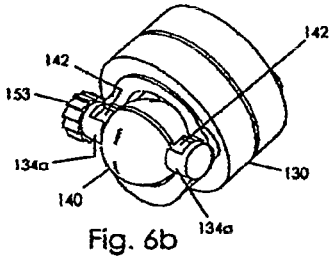

Fig. 6b

Signed and Sealed this

Seventh Day of November, 2006

JON W. DUDAS
*Director of the United States Patent and Trademark Office*

US006955282B1

(12) United States Patent
Kimple

(10) Patent No.: US 6,955,282 B1
(45) Date of Patent: Oct. 18, 2005

(54) MAGNETICALLY OPERATED DRIVING TOOL

(76) Inventor: David W. Kimple, 1159 N. Donald La., Conway Springs, KS (US) 67031

( * ) Notice: Subject to any disclaimer, the term of this patent is extended or adjusted under 35 U.S.C. 154(b) by 0 days.

(21) Appl. No.: 10/833,230

(22) Filed: Jul. 30, 2004

(51) Int. Cl.[7] ..... B25C 1/04

(52) U.S. Cl. ..... 227/131; 227/129; 227/113; 173/202

(58) Field of Search ..... 227/113, 131, 129, 227/156; 173/114, 117, 202; 310/80, 103

(56) References Cited

U.S. PATENT DOCUMENTS

| | | | | |
|---|---|---|---|---|
| 2,943,216 | A * | 6/1960 | Spodig | 310/103 |
| 2,967,302 | A * | 1/1961 | Loveless | 173/117 |
| 3,609,425 | A * | 9/1971 | Sheridan | 310/103 |
| 3,899,703 | A | 8/1975 | Kinnison | |
| 4,011,477 | A * | 3/1977 | Scholin | 310/80 |
| 4,183,453 | A | 1/1980 | Barrett et al. | |
| 4,370,906 | A * | 2/1983 | Gurries | 81/464 |
| 4,371,798 | A * | 2/1983 | Kuroda | 310/80 |
| 4,491,262 | A * | 1/1985 | Ewig | 227/131 |
| 4,511,074 | A * | 4/1985 | Kille et al. | 227/113 |
| 4,611,742 | A | 9/1986 | Rieker et al. | |
| 5,584,367 | A * | 12/1996 | Berdut | 188/267 |
| 6,232,689 | B1 | 5/2001 | Fujita et al. | |
| 6,364,193 | B1 | 2/2002 | Tsai | |
| 6,433,452 | B1 | 8/2002 | Graham | |
| 6,517,560 | B1 * | 2/2003 | Toth et al. | 606/171 |
| 6,796,477 | B2 * | 9/2004 | Chen | 227/2 |

* cited by examiner

*Primary Examiner*—Scott A. Smith

(57) ABSTRACT

A magnetically operated driving tool includes a body member, first and second stator magnets at opposed ends of the body with like poles facing one another, a movable magnet (traveler), a coupling adjacent each stator coupled to a user-operable linkage, a hammer, and a spring. In use, the traveler begins magnetically coupled to the first stator and engaged with the first coupling; the hammer holds a fastener. A user operates the linkage, rotating the traveler until its and the first stator's polarity match. The first stator magnetically repulses the traveler, which propels the hammer to insert the fastener and moves to the second stator where it engages the second coupling. The user operates the linkage, causing the traveler to rotate until its and the second stator's polarity match. The second stator then magnetically repulses the traveler, which engages the spring and reaches the first stator, returning to the initial configuration.

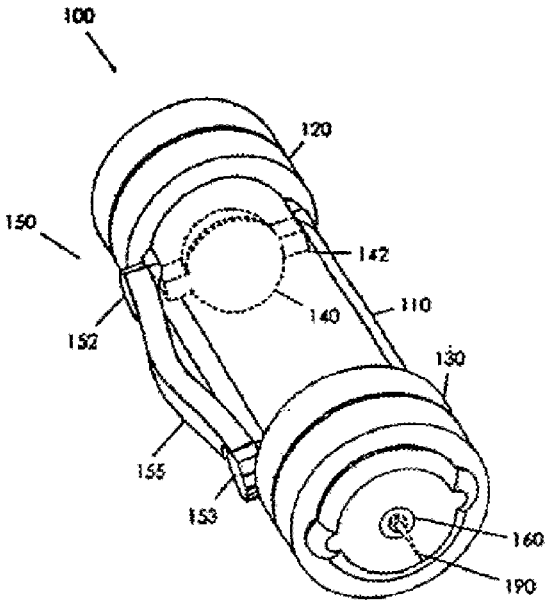

19 Claims, 6 Drawing Sheets